United States Patent [19]

Couchoud

[11] 4,304,814

[45] Dec. 8, 1981

[54] FLAMEPROOF TEXTILE ARTICLES BASED ON HALOGEN-CONTAINING MODACRYLIC POLYMERS

[75] Inventor: Paul Couchoud, Dardilly, France

[73] Assignee: Rhone-Poulenc Textile, Paris, France

[21] Appl. No.: 166,310

[22] Filed: Jul. 7, 1980

Related U.S. Application Data

[63] Continuation of Ser. No. 685,133, May 11, 1976, abandoned.

[30] Foreign Application Priority Data

May 15, 1975 [FR] France ..... 75 15581

[51] Int. Cl.[3] ..... C09K 3/28

[52] U.S. Cl. ..... 428/266; 428/272; 428/921

[58] Field of Search ..... 428/266, 272, 921

[56] References Cited

U.S. PATENT DOCUMENTS

| | | | |
|---|---|---|---|
| 3,637,427 | 1/1972 | Tsuruta et al. | 427/387 X |
| 3,759,851 | 9/1973 | Carl et al. | 427/393.3 X |
| 3,962,500 | 6/1976 | Smith | 428/266 X |

*Primary Examiner*—James R. Hoffman

*Attorney, Agent, or Firm*—Stevens, Davis, Miller & Mosher

[57] ABSTRACT

The present invention relates to flameproof textile articles and to processes for obtaining the same. The textile articles consist or consist essentially of halogen-containing modacrylic polymers containing on their surface about 0.2% to 2% by weight of silica relative to the weight of the articles. They are obtained by treatment with an emulsion of a hydrogenopolysiloxane compound in the presence of a curing catalyst, followed by a heat treatment at a temperature which can vary between about 100° and 160° C. They are of great value in certain flameproof textile applications such as household furnishings and garments.

2 Claims, No Drawings

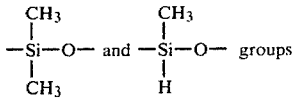

(these latter being present above all at the chain end), the number and location of the hydrogen atoms in the molecule being capable of extensive variation. The presence of hydrogen atoms bound directly to a silicon atom is necessary to permit the crosslinking which makes it possible to render the compound infusible and make it very fast to repeated washing.

The actual treatment of the textile articles is carried out by means of a hydrogenopolysiloxane described above, in emulsion and in the presence of a catalyst. The catalyst used is generally an organometallic salt of zinc, tin or zirconium, or butyl titanate, the catalyst only being added at the time of use. Catalysts such as dibutyltin-diacetate or -dilaurate, zinc octoate, triethanol amine titanate, and the like are also suitable, either alone or in admixture. The treatment can be carried out on a woven fabric or a knitted fabric, in accordance with the usual techniques, for example dipping or padding followed by draining, to achieve better penetration of the treating agent. The treatment can also be carried out on a yarn, a sliver or wadding, or in the course of sizing. Finally, and preferably, it can be carried out during the formation of the filaments comprising the yarn, for example during wet spinning when the filaments are still swollen with water after washing and, if appropriate, drawing. The article is then heat-treated to permit crosslinking of the polysiloxane, the treatment time being variable in accordance with the temperature which the article can withstand. For example, at a temperature of 100° C. the treatment can last several minutes, at 150° C. one minute suffices, and at 160° C. only a few seconds are necessary for crosslinking. The crosslinking is necessary to render the compound infusible and thereby make it resistant to repeated washes.

It is possible, for reasons of economy, to combine the treatment with the hydrogenopolysiloxane with a treatment with other known and compatible finishes. In that case, a single bath containing the silicone and its catalyst, as well as the other finish in question, is used.

The halogen-containing modacrylic textile articles according to the present invention possess, on their surface, an amount of the hydrogenopolysiloxane compound such that the proportion of silica deposited thereon is between 0.2% and 2%.

In addition to their excellent flame resistance, the treated modacrylic articles are waterproof, without the pores of the textile material being obstructed, so that the articles are able to retain good air permeability and a desirable textile appearance. However if, due to an excessively high pressure, water nevertheless passes through the textile article, the latter dries more rapidly than in the case of an untreated textile article. As a result, the finished textile article is more resistant than a textile article which has not been finished in this way, with respect to aqueous stains which are easily removed without leaving traces; this is of great importance in certain applications such as furnishings and garments, for which the halogen-containing modacrylic textiles are largely used.

Finally, the textiles treated in this way have an agreeable handle which is more supple and softer, and they also possess markedly improved abrasion resistance.

The examples which follow, and in which the parts are to be understood as by weight, are given by way of illustrations but without implying any limitation, and merely in order still better to illustrate the invention.

EXAMPLE 1

A. A woven fabric is produced from a halogen-containing modacrylic fiber composed of (a) 98 parts of a copolymer of acrylonitrile (64% by weight), vinylidene chloride (35% by weight), and sodium methallylsulphonate (1% by weight), and (b) 2 parts of antimony oxide. The fabric, weighing 190 g/m$^2$, is produced from a spun yarn (Nm 13/2, or 77 tex) of fibers of gauge 6.5 dtex. It is conditioned at 22° C. and 60% relative humidity.

Electric heater test: combustion commences at about 25 seconds and the mean duration of combustion is 65 seconds. The sample shrinks, forms holes as the heater is brought near, and burns completely when ignited.

Classification: $M_4$ (easily inflammable).

"Portique" test: the surface destroyed is between 20 and 30 cm$^2$. The flame does not propagate.

B. A part of the same woven fabric is given a finish by means of an emulsion containing 20 g/l of hydrogenopolysiloxane, known commercially under the trademark S1(104) of RHONE-POULENC INDUSTRIES, and 2 g/l of a catalyst known commercially under the trademark "X and Y 21", offered by RHONE-POULENC INDUSTRIES for curing their resin, and consisting of a mixture of zinc octoate and dibutyltin diacetate in the form of an emulsion.

The treatment is carried out by padding in an aqueous bath.

The textile treated in this way is thereafter subjected to a heat treatment for 1 hour at 100° C. in an oven.

The silica deposited on the fabric in this manner is 1.1% by weight. The fabric is then conditioned at 22° C. and 60% relative humidity after which it is subjected to the following tests:

Electric heater test: no ignition; the height destroyed is 16–17 cm, corresponding to the zone pyrolysed by the heater. The shrinkage of the fabric during application of the heater is very slight or nil. Such a fabric is classified as $M_1$: noninflammable, under current French legislation.

"Portique" test: the average surface destroyed is 17 cm$^2$ for a height of 8 cm. Classification: $M_1$.

LOI: 28.6.

The comparison of the results of these flameproofing tests shows clearly the marked superiority of sample B according to the present invention.

EXAMPLE 2

A 28% strength by weight solution, in dimethylformamide, of a copolymer containing 64% by weight of acrylonitrile, 35% by weight of vinylidene chloride and 1% by weight of sodium methallylsulphonate is prepared, and 3% of water, relative to the weight of the copolymer, is added thereto.

The solution is extruded through a spinneret of 64 orifices into an aqueous coagulating bath containing 53% of dimethylformamide at 5° C. The filaments are stretched in air at ambient temperature to a ratio of 1.2 X and are then washed in counter-current, after which they are first relaxed in boiling water to a ratio of 0.8 X

FLAMEPROOF TEXTILE ARTICLES BASED ON HALOGEN-CONTAINING MODACRYLIC POLYMERS

This is a continuation of application Ser. No. 685,133, filed May 11, 1976, now abandoned.

The present invention relates to flameproof textile articles based on halogen-containing modacrylic polymers, as well as to processes for obtaining the said articles with the aid of hydrogenopolysiloxane derivatives.

By halogen-containing modacrylic polymers there are understood polymers consisting or consisting essentially of 50% to 85% by weight of acrylonitrile units, about 20% to 50% by weight of units originating from a halogen-containing comonomer such as vinyl chloride or vinylidene chloride, and a low percentage, generally less than 10%, and preferably less than 5% by weight, of units of a compound intended to improve the dye affinity of the polymer, such as basic compounds and preferably acid compounds (for example itaconic acid, vinyloxybenzenesulphonic acid and allylsulphonic or methallylsulphonic acids) or their salts, used either by themselves or mixed with comonomers having a side chain of greater steric bulk than the nitrile groups, for example acrylamide and its derivatives, methyl acrylate and methyl methacrylate, vinyl acetate, and the like.

It is also possible to use mixtures of modacrylic polymers.

Silicone finishes are usually employed to modify the handle, the hydrophilic nature and the impermeability of numerous textile materials such as those based on acrylic polymers, polyesters, polyamides, and the like.

It is also known, according to French patent application Ser. No. 2,175,795, to improve the resistance to ignition of fabrics based on polybenzimidazole or on aromatic polyamides or of phenolic fabrics by applying to the fabric from 0.5% to 5.0% by weight of a mixture containing 10% to 30% by weight of a liquid polydimethylsiloxane having terminal hydroxyl groups and 90% to 70% of a methylhydrogenopolysiloxane having at least three hydrogen atoms linked to the silicon, plus a curing catalyst for the composition, and then curing the composition on the fabric.

Furthermore, a paper which appeared in the review "Textile Chemist and Colorist", Volume 6, Number 5, under the title "How Silicones Affect Fabric Flammability", specifies that the application of a siloxane coating improves the flame resistance of textiles which already have good flame resistance, such as Nomex (a trademark of E. I. du Pont de Nemours & Co.), Durette (a trademark of the Monsanto Company), or polybenzimidazole, but that the same coating applied to polyester fibers (trademark Kodel II) results in a substantial reduction in the flame resistance.

It is also known that silicone finishes significantly increase the combustibility of yarns based on aliphatic polyamides, such as polyhexamethylene adipamide.

It thus appears from these last two examples that the application of siloxane products may have an adverse effect on the fire resistance of common textiles.

Textiles based on halogen-containing modacrylic polymers are of great interest because of their very good textile properties, but they have insufficient flame resistance for certain uses such as, for example, furnishings.

Flameproof textile articles have how been found, characterized in that they consist of halogen-containing modacrylic polymers treated with a hydrogenopolysiloxane compound in such amounts that the proportion of silica deposited thereon varies between 0.2% and 2% by weight of the textile article.

The invention also relates to a process for obtaining flameproof textile articles based on halogen-containing modacrylic polymers, by treating the said articles with a hydrogenopolysiloxane compound in the presence of a catalyst, and then carrying out a heat treatment at a temperature of about 100° to 160° C.

The term "flameproof textile articles" is to be understood herein as meaning articles which have very favorably undergone the principal statutory flameproofing tests:

Determination of the LOI (Limiting Oxygen Index): This is determined in accordance with Standard Specification ASTM B 2863-70 relating to plastic samples, modified and adapted to textile samples of size 5×15 cm, mounted on a rectangular frame.

The electric heater test (described in the Journal Officiel de la République Française (Official Journal of the French Republic) of July 26, 1973, pages 8134 to 8137) which consists in subjecting a textile sample of size 18×60 cm to heat radiation, a butane gas igniter making it possible to ignite the pyrolysis gases. The igniter is presented three times over the course of 5 seconds, the sample being inclined at an angle of 30°. The length destroyed and the time which the sample takes to ignite are measured.

The "Portique" test which consists of setting on fire a vertical sample by means of 2 $cm^3$ of burning alcohol. This test is based on a Decree of Dec. 9, 1957 of the French Ministry of the Interior, and was published in the Journal Officiel de la République Française (Official Journal of the French Republic) of Jan. 16, 1958, page 611. According to this method, the values of the surfaces destroyed correspond to the following descriptions: less than 60 $cm^2$: the sample is "non-inflammable"; from 60 to 100 $cm^2$: the sample is "inflammable with difficulty"; from 100 to 200 $cm^2$: the sample is of medium inflammability; and more than 200 $cm^2$: the sample is easily inflammable.

The "Portique" test and the electric fire test make it possible to classify textile articles as $M_1$ to $M_4$, the various categories $M_1$, $M_2$, $M_3$ and $M_4$ being described in the aforesaid Journal Officiel (Official Journal) of July 26, 1973 (Articles 71, 72, 73 and 74).

The halogen-containing modacrylic textile articles containing 0.2% to 1% of silica enjoy classification $M_1$, the most favorable, whilst the untreated halogen-containing modacrylic textile articles have classifications ranging from $M_2$ to $M_4$.

Furthermore, the determination of the LOI gives excellent results with such textile articles.

It is thus interesting to note that the textile articles according to the present invention give favorable results when subjected to the three tests described above, these tests being based on different principles, which proves the good flameproofing of the products according to this invention.

The hydrogenopolysiloxanes or methylhydrogenopolysiloxanes which can be used according to the present invention are compounds which per se are well-known as waterproofing agents in the textile finishing industry. They are compounds containing the following groups in the molecule:

(20% relaxation) and finally stretched to a ratio of 5 X in boiling water.

The filaments are then passed over a sizing roller revolving in a bath containing 25 g/l of the same hydrogenopolysiloxane and 2.5 g/l of the same catalyst as in Example 1.

The yarn obtained is dried by passing it continuously for 10 minutes through a chamber wherein the dry bulb temperature is 100° C. and the wet bulb temperature is 65° C., and then for 5 minutes at a dry bulb temperature of 150° C.

The yarn thus obtained contains 0.29% by weight of silica. It is supple and has good flame resistance properties.

EXAMPLE 3

Example 2 is repeated, but this time using a bath containing 50 g/l of the same hydrogenopolysiloxane and 5 g/l of the same catalyst.

The yarn obtained is dried by passing it for 10 minutes through a chamber at a dry bulb temperature of 130° C. and a wet bulb temperature of 65° C., and then for 5 minutes at a dry bulb temperature of 150° C.

The yarn obtained contains 0.44% by weight of silica. It is supple and has good flame resistance properties.

What is claimed is:

1. A flameproof textile article consisting essentially of a halogen-containing modacrylic polymer treated with a hydrogenopolysiloxane compound such that the proportion of hydrogenopolysiloxane, expressed in terms of $SiO_2$ contained therein, is between about 0.2% and 2% by weight of the treated article.

2. A flameproof textile article as defined in claim 1, wherein the halogen is chlorine.

* * * * *